United States Patent [19]

Croley

[11] 4,225,078

[45] Sep. 30, 1980

[54] KNOCKED-DOWN POLYGONAL CONTAINER WITH SET-UP CONTOUR-FORMING FLAPS

[75] Inventor: Thomas E. Croley, Worthington, Ohio

[73] Assignee: Willamette Industries, Inc., Portland, Oreg.

[21] Appl. No.: 44,453

[22] Filed: Jun. 1, 1979

[51] Int. Cl.[3] ..... B65D 5/08

[52] U.S. Cl. ..... 229/41 C; 229/8

[58] Field of Search ..... 229/41 C, 23 C, 23 BT, 229/8

[56] References Cited

U.S. PATENT DOCUMENTS

| | | | |
|---|---|---|---|
| 1,425,549 | 8/1922 | Scruby | 229/41 C |
| 1,892,714 | 1/1933 | Wellman | 229/8 X |
| 2,050,894 | 8/1936 | Paige | 229/8 X |
| 2,285,174 | 6/1942 | Simons | 229/41 C |
| 2,565,188 | 8/1951 | Welshembach | 229/41 C X |
| 4,119,266 | 10/1978 | Dempster | 229/41 C X |
| 4,146,169 | 3/1979 | Meyers et al. | 229/41 C |

*Primary Examiner*—Davis T. Moorhead
*Attorney, Agent, or Firm*—William V. Miller

[57] ABSTRACT

A container of fiberboard or similar material which is supplied in flat knocked-down condition but when set up will be of multi-sided polygonal tubular form to give it increased stacking strength. A bottom flap arrangement includes at least two hinged flaps which, when folded with their inner free edges meeting, provide a form of the complete area and contour of the tubular container body being set up and will guide the side walls thereof into that size and contour as they are positioned around the remaining unhinged edges of such form flaps.

11 Claims, 7 Drawing Figures

KNOCKED-DOWN POLYGONAL CONTAINER WITH SET-UP CONTOUR-FORMING FLAPS

BACKGROUND OF THE INVENTION AND PRIOR ART

This invention relates deals with fiberboard containers, such as those made from corrugated board, which are of the larger sizes intended mainly for packing and shipping bulk material and which are usually carried on pallets. Many of these containers are of square or rectangular from and the vertical wall panels thereof tend to bulge transversely and in a vertical direction when they are stacked. This is due to the fact that the compressive strength of the box is derived mainly from the vertical fold corners thereof. Attempts have been made in the prior art to increase the compressive strength by changing the cross-sectional shape of the container from quadrangular to a polygonal shape having more than four corner fold lines or joints so as to increase its compressive strength and thereby resistance to bulging upon stacking. However, usually this causes difficulty in setting-up the tubular body of the container from the flat knocked-down condition in which it is supplied, as it is a struggle to get it to assume and retain the proper polygonal shape unitl it is fastened in that shape. In many cases, it is necessary to provide a separate end tray of proper polygonal form in which the tubular body is set and secured to obtain and retain its shape.

SUMMARY OF THE INVENTION

The present invention provides a container made substantially without waste of material from a blank of fiberboard, preferably corrugated board, so that when it is set up it will be of polygonal horizontal cross-section with vertical fold lines providing more than four angular joints or corners. It is preferably of elongated octagonal form and is of large size to hold bulk material though not necessarily so. It is provided with a bottom flap arrangement with hinged flaps connected to each of the side panels, with the two flaps hinged to the main or longer panels, being of such area and shape, that when their free edges are brought together, they will have the complete cross-sectional area and contour of the polygonal tubular body of the container to be set up. As the body is set up and the inner edges of the form flaps are brought together, the tubular body is expanded and formed around the remaining free edges of the form flaps to the exact complete polygonal shape and cross-section desired. The flaps may be secured together or attached to a pallet to retain the set-up size and shape. No exterior forming means is needed. Thereafter, the multiple vertical fold joints or corner angles will serve to more adequately resist bulging upon stacking.

BRIEF DESCRIPTION OF THE DRAWINGS

The best mode contemplated in carrying out this invention is illustrated in the accompanying drawings in which.

DETAILED DESCRIPTION OF THE INVENTION

Figure 1:
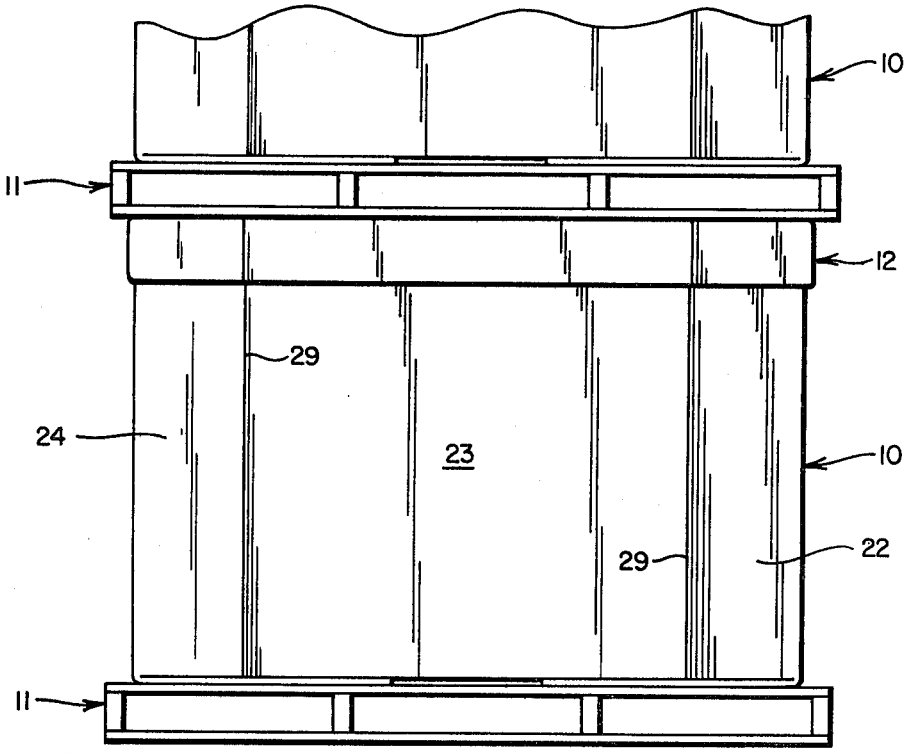
FIG. 1 is a side elevational view of a container embodying this invention and indicating how another can be stacked on it.
Figure 2:
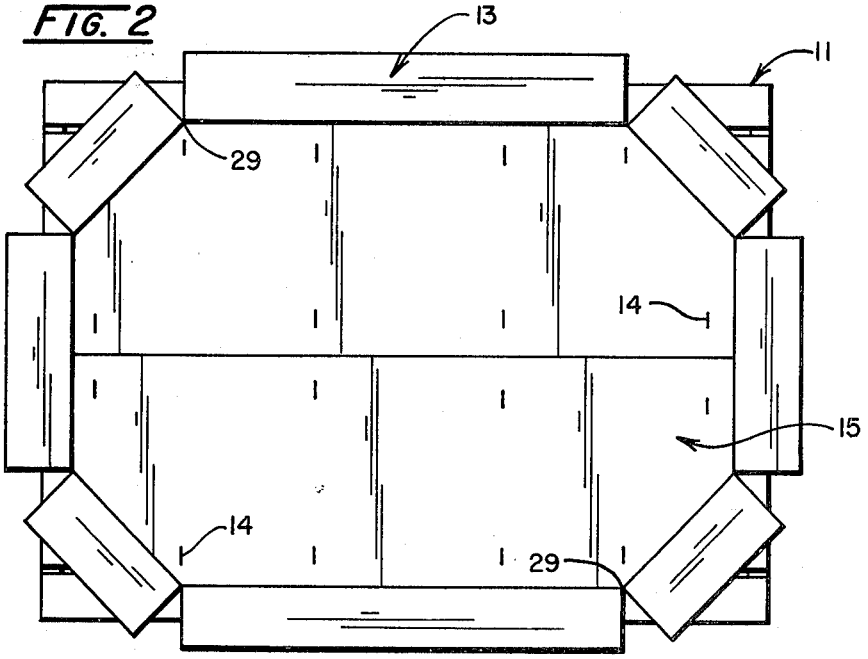
FIG. 2 is a plan view of the container.

With specific reference to the drawings, in FIG. 1, there is illustrated a container 10 of elongated octagonal form made according to this invention. It is shown resting on a pallet 11, although this is not necessarily so. A cap 12 of the inverted tray type is shown slipped over its upper end but the specific structure of this cap is not important to this invention. The set-up body of the container is tubular and its top edge may be provided with the flap arrangement 13 but other flap arrangements may be provided if desired. This invention relates mainly to the bottom flap structure indicated generally at 15 in FIG. 2 and which is shown fastened to the pallet 11 by staples 14. In FIG. 1, it is indicated that two or more of the containers of this invention can be stacked since the container is designed and constructed to resist bulging. This is due mainly to the provision of the eight corners instead of the usual four on this type of bulk material container. However, to facilitate the setting up of the container, the bottom flap arrangement 15 is of special design and construction.

Figure 3:
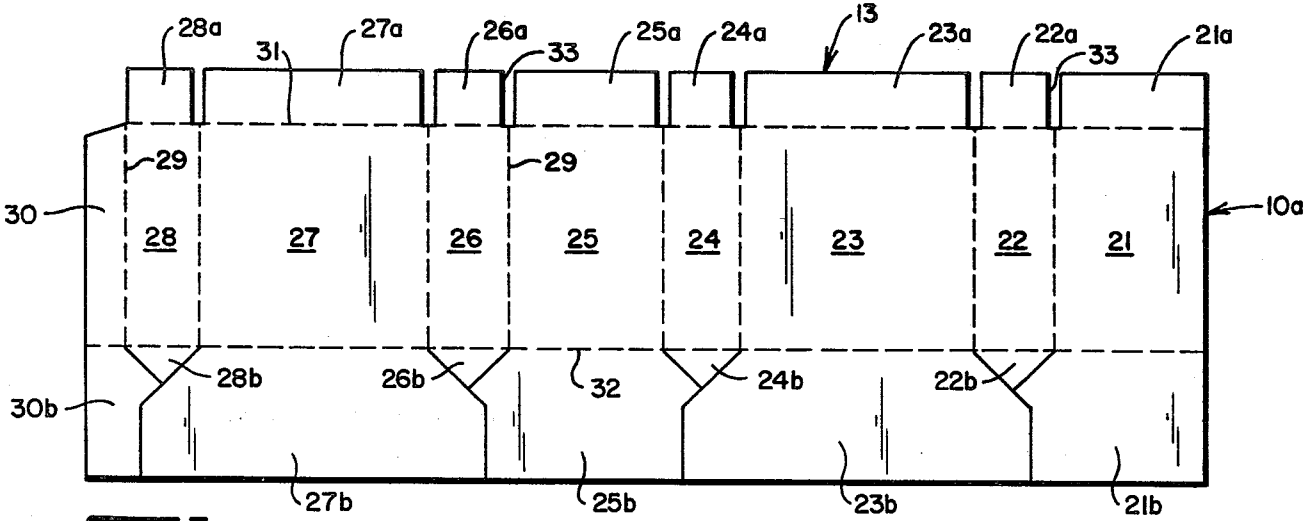
FIG. 3 is a plan view of the blank for the container.

The container 10 is made from the blank **10*a* indicated in FIG. 3. For simplicity, this blank is shown as a single lamination, preferably of corrugated board, but in actual practice, may be of two or more laminations. It is cut, slit and scored to provide the wall-forming panels 21, 22, 23, 24, 25, 26, 27, and 28 hinged together along vertical score lines 29. When the container body is set up into tubular form, these panels will provide the eight vertical walls with corners at each hinge line 29. Hinged to the panel 28 at a vertical score line 29 is a construction or attaching flange 30 which is adapted to overlap the outer edge of panel 21 when the tubular body of the container is formed. If the flap arrangement 13 is to be provided, the panels 21, 22, 23, 24, 25, 26, 27 and 28, will have hinged thereto at the horizontal score lines 31, the respective flaps 21*a*, 22*a*, 23*a*, 24*a*, 25*a*, 26*a*, 27*a* and 28*a* which are separated by slots 33. As indicated before, the bottom flap arrangement 15 is special and will consist of the flaps 21*b*, 22*b*, 23*b*, 24*b*, 25*b*, 26*b*, 27*b* and 28*b*, hinged to the respective flaps 21, 22, 23, 24, 25, 26, 27 and 28 along the horizontal score lines 32. In addition, a flap 30*b* is hinged to the flange 30 along score line 32**.

Figure 4:
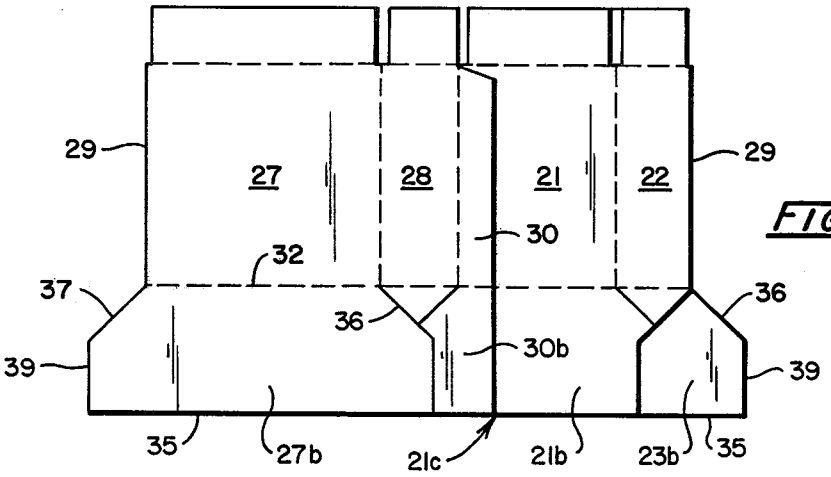
FIG. 4 is an elevational view of the flat knocked-down container formed from the blank.

It will be noted that the blank **10*a* can be formed from a sheet of material with substantially no loss of material. To produce the tubular container body, the blank will be folded at two vertical hinge lines 29, the one being between the panels 22 and 23 and the other being between the panels 26 and 27, as indicated in FIG. 4, to provide the knocked-down flat which is the condition the container is in when received by the packer. The flange 30 will be glued or otherwise attached to the panel 21 and the flap 30*b* to the flap 21*b* so that the flap assembly 21*c* will be the same size and shape as flap 25*b*. The two flaps 23*b* and 27*b* are what may be termed the form flaps and with their outer edges brought together, in setting up the knocked-down tubular body, will provide an area and contour corresponding to that of the octagon tubular body which it is desired to set up. It will be noted that these flaps project downwardly in FIG. 4 along with the other bottom flaps. The largest flaps 23***b* and 27*b* will be on the elongated side walls to be formed by panels 23 and 27 and will project in opposite directions beyond each corner hinge joint 29 thereof, the next larger flaps 21*b* and 25*b* will be on the end walls to be formed by panels 21 and 25 and the small triangular flaps 22*b*, 24*b*, 26*b* and 28*b* are on the panels 22, 24, 26 and 28 which will be on the small angular connecting walls.

The size and shape of the form flaps 23*b* and 27*b* are critical. Each flap is of hexagonal shape and equal in area to onehalf the cross-sectional area of the tubular body of the container. At the hinge joint 32, each of these flaps is coextensive with the side panel 23 or 27 to which it is hinged. However, the outer free edge 35 of each form flap is longer, being of an extent equal to the length of the container between the end walls 21 and 25 and is parallel to the inner edge. These edges 32 and 35 preferably are spaced apart one-half the distance desired between side walls to be formed by panels 23 and 27. The opposite angular edges 36 and 37 are each at the same angle as the respective connecting walls 22 and 24 or 26 and 28 with which they are to cooperate and are of the same extent as the width of the walls. The remaining opposite straight end edges 38 and 39 are parallel with each other and at right angles to the edges 35 and 32 and further are of one-half the width of the end wall panel 21 or 25. The small flaps 22*b*, 24*b*, 26*b* and 28*b*, are triangular and are hinged to the respective connecting wall panels 22, 24, 26, and 28 at the hinge joints 32. The single end flap 25*b* and the opposed end flap assembly 21*c* will be hinged to the connecting wall panels 25 and 21, respectively, and will be coextensive therewith at the hinge joints. As previously indicated, the end flap assembly 21*c* is a combination of flaps 21*b* and 30*b*.

Figure 5:
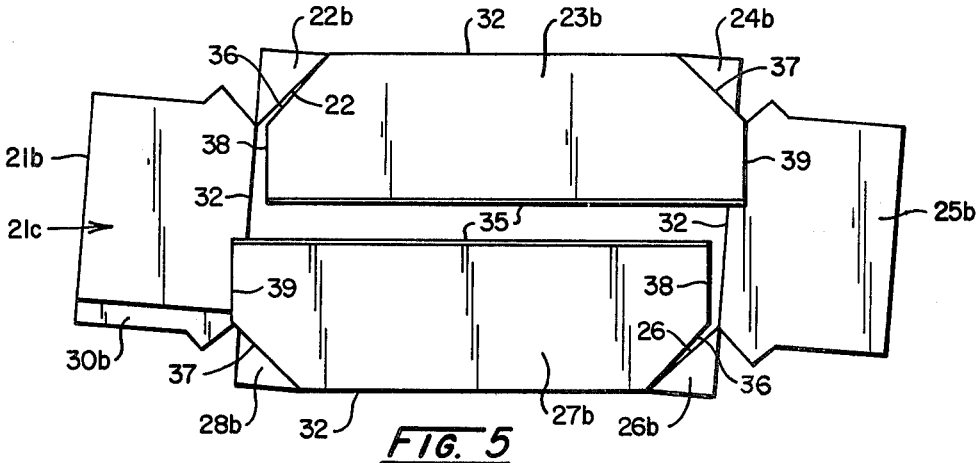
FIG. 5 is a schematic bottom view showing the start of the setting up of the container.
Figure 6:
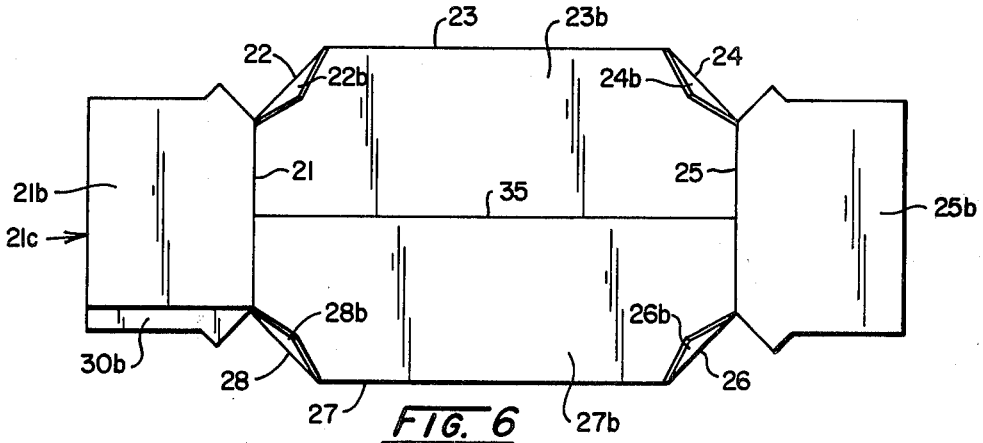
FIG. 6 is a similar view showing the next step where the form-flaps of the bottom are brought together to produce the complete polygonal cross-section or contour of the tubular container body.
Figure 7:
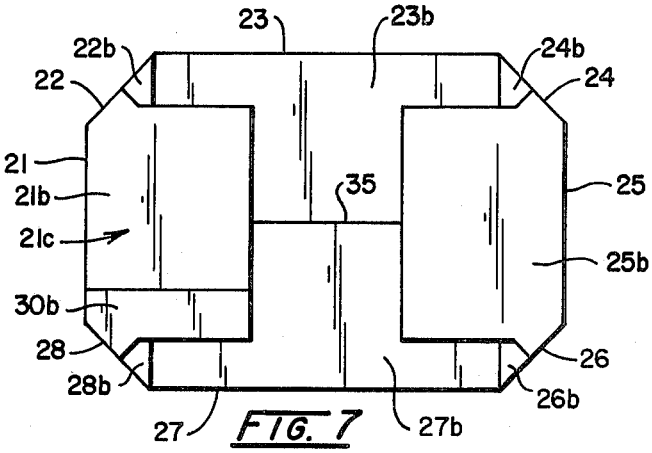
FIG. 7 is a plan view of the bottom after all the bottom flaps are folded into place.

In setting up the tubular container body from the knocked-down condition of FIG. 4, the first step is indicated in FIG. 5, which eliminates the top flap arrangement 13 for clarity. In this Figure, the body is shown being expanded and the form flaps 23*b* and 27*b* are partially turned inwardly. As the inner edges 35 thereof are brought together, the tubular body will be expanded to its proper polygonal shape with the main elongated side walls 23 and 27 opposite, as shown in FIG. 6, and at the same time the end walls 21 and 25 and the connecting angular walls 22, 24, 26 and 28 will be formed around the remaining free edges 38, 39, 36 and 37 of the form flaps 21*b* and 27*b*. This will complete the expansion and formation of the tubular body into the complete elongated octagonal shape. Then, the smaller triangular flaps 22*b*, 24*b*, 26*b* and 28*b* are turned inwardly into overlapping relationship to the form flaps 23*b* and 27*b* and, finally, the end flaps 21*c* and 25*b*, are turned inwardly over the overlapping triangular and form flaps. Then, the formed container may be rested on a pallet 11 and be secured thereto by staples 14 through the overlapping bottom flaps. If a pallet is not used, the overlapping bottom flaps may be stapled or otherwise fastened together. All the various flaps, when fastened together, will tend to keep in place the vertical walls to which they are hinged and prevent outward movement thereof at their lower portions.

It will be apparent that this invention provides a fiberboard container of polygonal tubular form with more than four corners to obtain increased compressive strength. The container is made from a single sheet of material with practically no waste and is supplied in knocked-down form. Setting up is facilitated by the bottom flap arrangement which consists of at least two form flaps hinged to side wall panels of such size and shape that, when their inner edges are brought together, they bring the attached panels into position and provide a form for the complete contour and area of the desired polygonal tubular body.

Having thus described this invention, what is claimed is:

1. A blank for a container of fiberboard or the like comprising a tubular body of octagonal horizontal cross-section having eight upstanding wall panels connected together at vertical corners, and a bottom flap arrangement on the body including two inwardly extending horizontally disposed flaps connected at their outer edges to respective opposed wall panels and having their inner edges meeting, said flaps together being of the same cross-sectional area and contour as the tubular body of the container; said blank consisting of a flat sheet of fiberboard material cut, slit and scored to provide eight wall-forming panels including two side wall panels, two end wall panels and four connecting panels, connected hingedly together at laterally spaced, vertically extending score lines; and a bottom flap arrangement hinged on the lower side of said sheet along a common horizontal score line including two form flaps which are connected to said side wall panels, each of said form flaps being of hexagonal form and one-half the area and contour of the octagonal horizontal cross-section of the container body and having an edge hinged to its respective side wall panel and co-extensive therewith, an opposed edge of a length corresponding to the spacing of the end walls in the body of the container and space from the hinged edge a distance which is one-half the spacing of the side walls, in the body of the container and connecting end edges to engage and position the said end and connecting panels, each of said connecting end edges including a straight edge at a right angle to said outer edge of a length equal to one-half the width of an end panel and another edge extending angularly therefrom to said horizontal score line at the adjacent vertical score line; said two side panels having a connecting panel hinged respectively to one edge with an end panel hinged intermediate the two connecting panels at vertical score lines, one of the remaining connecting panels having one edge hinged at a vertical score line to the adjacent side panel to be outermost, the other connecting panel being hinged at vertical score lines intermediate the other end panel and the adjacent side panel so that the end panel is outermost, an attaching flange hinged at a vertical score line to the outermost connecting panel; the bottom flap arrangement consisting of the said form flaps hinged at the horizontal score line to the side panels, an end flap hinged at the horizontal score line to the intermediate end panel, a partial end flap hinged at the horizontal score line to said outermost end panel, and a partial end flap hinged at the horizontal score line to said attaching flange, said intermediate end flap having opposed angled edges extending outwardly from the horizontal hinge score line at adjacent vertical score lines and perpendicularly to the respective angled edges of the adjacent form flaps to provide triangular flaps therebetween which are hinged at the horizontal score line to the adjacent connecting panels, said outermost end flap having one such angular edge perpendicular to the adjacent angled edge of the form flap forming a triangular flap on the adjacent connecting panel, said partial end flap hinged to said attaching flange at said horizontal score line also having an angled edge extending from the adjacent vertical hinge score line and at a right angle to the angled edge of the adjacent form flap to produce a triangular flap hinged at the horizontal score line on the adjacent outermost connecting panel.

2. A blank according to claim 1 in which the side wall panels are wider than the end wall panels so that the container formed therefrom will be of elongated octagonal form.

3. A flat formed from the blank of claim 1 or claim 2 folded flat along two vertical score hinge lines to provide two super-imposed flat sides with one flat side having the said attaching flange and the said partial end flap hinged thereto disposed in overlapping attached relationship, respectively, with the said outermost end wall panel and the said partial end flap hinged thereto.

4. A container set up from the flat or claim 3 expanded along said vertically extending score lines into the body of octagonal tubular cross-section and with all the flaps of the bottom arrangement turned inwardly into substantially horizontal positions along their respective horizontal score lines, the inner edges of the hexagonal from flaps meeting, the said triangular flaps being turned inwardly over the respective angled edges of said form flaps and the said end flaps being turned inwardly over the respective straight edges at the ends of the form flaps beneath such flaps and beneath the triangular flaps to hold them in position.

5. A blank for a container of fiberboard or the like comprising a tubular body of octagonal horizontal cross-section having eight upstanding wall panels connected together at vertical corners, and a bottom flap arrangement on the body including two inwardly extending horizontally disposed flaps connected at their outer edges to respective opposed wall panels and having inner edges spaced inwardly therefrom, said blank consisting of a flat sheet of fiberboard material cut, slit and scored to provide eight wall-forming panels including two side wall panels, two end wall panels and four connecting panels, connected hingedly together at laterally spaced, vertically extending score lines; and a bottom flap arrangement hinged on the lower side of said sheet along a common horizontal score line including two form flaps which are connected to said side wall panels, each of said form flaps having an edge hinged to its respective side wall panel and co-extensive therewith, an opposed edge of a length corresponding to the spacing of the end walls in the body of the container and spaced from the hinged edge a selected distance and connecting end edges to engage and position the said end and connecting panels, each of the form flaps having its said connecting end edges each including a straight edge and another edge extending angularly therefrom to said horizontal hinge score line at the adjacent vertical score line; with the straight edge at a right angle to said horizontal hinge score line; said two side panels having a connecting panel hinged respectively to one edge with an end panel hinged intermediate the two connecting panels at vertical score lines, one of the remaining connecting panels having one edge hinged at a vertical score line to the adjacent side panel to be outermost, the other connecting panel being hinged at vertical score lines intermediate the other end panel and the adjacent side panel so that the end panel is outermost, an attaching flange hinged at a vertical score line to the outermost connecting panel; the bottom flap arrangement consisting of the said form flaps hinged at the horizontal score line to the side panels, an end flap hinged at the horizontal score line to the intermediate end panel, a partial end flap hinged at the horizontal score line to said outermost end panel, and a partial end flap hinged at the horizontal score line to said attaching flange, said intermediate end flap having opposed angled edges extending outwardly from the horizontal hinge score line at adjacent vertical score lines and perpendicularly to the respective angled edges of the adjacent from flaps to provide triangular flaps therebetween which are hinged at the horizontal score line to the adjacent connecting panels, said outermost end flap having one such angular edge perpendicular to the adjacent angled edge of the form flap forming a triangular flap on the adjacent connecting panel, said partial end flap hinged to said attaching flange at said horizontal score line also having an angled edge extending from the adjacent vertical hinge score line and at a right angle to the angled edge of the adjacent form flap to produce a triangular flap hinged at the horizontal score line on the adjacent outermost connecting wall.

6. A flat formed from the blank of claim 5 folded flat along two vertical score hinge lines to provide two superimposed flat sides with one flat side having the said attaching flange and the said partial end flap hinged thereto disposed in overlapping attached relationship, respectively, with the said outermost end wall panel and the said partial end flap hinged thereto.

7. A container set up from the flat of claim 6 expanded along said vertically extending score lines into the body of octagonal tubular cross-section and with all the flaps of the bottom arrangement turned inwardly into substantially horizontal positions along their respective horizontal score lines, the said triangular flaps being turned inwardly over the respective angled edges of said form flaps and the said end flaps being turned inwardly over the respective straight edges at the ends of the form flaps beneath such flaps and beneath the triangular flaps to hold them in position.

8. A folded flat of fiberboard or the like for use in producing a set-up container comprising a tubular body of octagonal horizontal cross-section having eight upstanding wall panels connected together at vertical corners, and a bottom flap arrangement on the body; said flat consisting of eight wall-forming panels including two side wall panels; two end wall panels and four connecting panels, all connected hingedly together at spaced, vertically extending corner hinge score lines, so it can be expanded into an octagonal tubular form body and a bottom flap arrangement hinged on the lower side of said flat along a common horizontal score line and including two form flaps which are connected to said side wall panels, two end flaps which are connected to said end wall panels and four flaps on the connecting panels; each of said form flaps being of hexagonal form and having an edge hinged to its respective side wall panel and co-extensive therewith, an opposed edge of a length corresponding to the desired spacing of the end walls in the body of the container and spaced from the hinged edge a selected distance, and connecting end edges to engage and position the said end wall and connecting panels, each of the connecting end edges including a straight edge and another edge extending angularly therefrom to said horizontal hinge score line at the adjacent vertical hinge score line with the straight edge at a right angle to said horizontal hinge score line; each of the end flaps having opposed angled edges extending outwardly from the horizontal hinge score line at adjacent vertical hinge score lines and perpendicularly to the respective angled edges thereof corresponding to the angled edges of the adjacent form flaps to provide triangular flaps which are hinged at the horizontal score line to the adjacent connecting panels; said flat being folded to provide two superimposed sides at two vertical hinge score lines each of which is between a side panel and an adjacent connecting panel so that each side of the flat consists of an outer connecting panel, an end panel, a second intermediate connecting panel and an outer side panel carrying their respective flaps and with the side and end panels at one side of the flat being laterally displaced from corresponding panels at the opposite side of the flat.

9. A folded flat according to claim 8 in which each hexagonal form flap has said opposed edge straight and spaced from its hinge edge one-half the spacing desired for the container side walls, and each of the other straight edges thereof is at a right angle to said last-named straight edge and of a length equal to one-half the width of an end panel.

10. A container of fiberboard or the like comprising a tubular body of octagonal horizontal cross-section having eight upstanding wall panels connected together at vertical corners including two side wall panels, two end wall panels and four connecting panels, connected hingedly together at laterally spaced, vertically extending corner score lines; and a bottom flap arrangement hinged on the lower side of said body and turned inwardly into substantially horizontal position along a common horizontal score line and including two opposed horizontal form flaps which are connected to said side wall panels and have their inner edges meeting, each of said form flaps being of hexagonal form and one-half the area and contour of the octagonal horizontal cross-section of the container body and having its one edge hinged to its respective side wall panel and co-extensive therewith, an inner edge of a length corresponding to the spacing of the end walls in the body of the container and spaced from the hinged edge a distance which is one-half the spacing of the container side walls, and connecting end edges to engage and position the said end wall and connecting panels, each of the hexagonal form flaps having its said connecting end edges each including a straight edge at a right angle to said inner edge of a length equal to one-half the width of an end panel and another edge extending angularly therefrom to said horizontal score line at the adjacent vertical score line, each of said end flaps having opposed angled edges extending inwardly from the horizontal hinge score line at adjacent vertical score lines and perpendicularly to the respective angled edges of the adjacent form flaps to provide triangular flaps which are hinged at the horizontal score line to the adjacent connecting panels, said triangular flaps being turned inwardly beneath and into contact with the form flaps and said end flaps being turned inwardly beneath the form flaps and said triangular flaps to hold them in position.

11. A container of fiberboard or the like comprising a tubular body of octagonal horizontal cross-section having eight upstanding wall panels connected together at vertical corners including two side wall panels, two end wall panels and four connecting panels, connected hingedly together at laterally spaced, vertically extending corner score lines; and a bottom flap arrangement hinged on the lower side of said body and turned inwardly into substantially horizontal position along a common horizontal score line and including two opposed horizontal form flaps which are connected to said side wall panels and have inner edges spaced inwardly therefrom, each of said form flaps being of hexagonal form and having its one edge hinged to its respective side wall panel and co-extensive therewith, an inner edge of a length corresponding to the spacing of the end walls in the body of the container and spaced from the hinged edge a selected distance and connecting end edges to engage and position the said end wall and connecting panels, each of the hexagonal form flaps having its said connecting end edges each including a straight edge at a right angle to said inner edge of a length equal to one-half the width of an end panel and another edge extending angularly therefrom to said horizontal score line at the adjacent vertical score line, each of said end flaps having opposed angled edges extending inwardly from the horizontal hinge score line at adjacent vertical score lines and perpendicularly to the respective angled edges of the adjacent form flaps to provide triangular flaps which are hinged at the horizontal score line to the adjacent connecting panels, said triangular flaps being turned inwardly beneath and into contact with the form flaps and said end flaps being turned inwardly beneath the form flaps and said triangular flaps to hold them in position.

* * * * *